US009134042B2

(12) United States Patent
Gao

(10) Patent No.: US 9,134,042 B2
(45) Date of Patent: Sep. 15, 2015

(54) INTEGRATED STRUCTURE OF AIR HEATER

(75) Inventor: Tianyu Gao, Shenzhen (CN)

(73) Assignee: Shenzhen Sunzone Electrical Appliances Ltd., Shenzhen, Guangdong (CN)

( * ) Notice: Subject to any disclaimer, the term of this patent is extended or adjusted under 35 U.S.C. 154(b) by 612 days.

(21) Appl. No.: 13/485,843

(22) Filed: May 31, 2012

(65) Prior Publication Data

US 2012/0304977 A1 Dec. 6, 2012

(30) Foreign Application Priority Data

Jun. 3, 2011 (CN) ..... 2011 2 0187449

(51) Int. Cl.

| | |
|---|---|
| ***F24D 15/02*** | (2006.01) |
| ***F24F 1/04*** | (2011.01) |
| ***F24H 3/02*** | (2006.01) |
| ***F24H 9/18*** | (2006.01) |
| ***F24H 3/04*** | (2006.01) |
| ***F24H 9/20*** | (2006.01) |

(52) U.S. Cl.

CPC ..... *F24H 9/1872* (2013.01); *F24H 3/0417* (2013.01); *F24H 9/2071* (2013.01); *Y10T 29/49826* (2015.01)

(58) Field of Classification Search

CPC ..... F24D 9/00; F24D 3/02
USPC ..... 219/202, 205, 208, 222, 520; 126/112; 392/365, 356, 358, 361; D23/317
See application file for complete search history.

(56) References Cited

U.S. PATENT DOCUMENTS

| | | | | |
|---|---|---|---|---|
| 4,260,875 | A * | 4/1981 | Walter et al. | 392/385 |
| 5,097,754 | A * | 3/1992 | Covington et al. | 99/357 |
| 2007/0045262 | A1 * | 3/2007 | Schehr | 219/202 |
| 2008/0124060 | A1 * | 5/2008 | Gao | 392/365 |

* cited by examiner

*Primary Examiner* — Dana Ross
*Assistant Examiner* — Lindsey C Teaters
(74) *Attorney, Agent, or Firm* — Raymond Y. Chan; David and Raymond Patent Firm

(57) ABSTRACT

An integrated structure of an air heater includes at least an air blowing unit, at least an air passage housing, a heating arrangement, and a overheat protection unit, which are fastened with each other to form the integrated structure, wherein the air blowing unit and the overheat protection unit are respectively fastened with the air passage housing, and the air passage housing is connected to the heating arrangement with screws. A simple and compact integrated structure for air heater is provided wherein its assembling method is easy and its manufacturing cost is low.

6 Claims, 9 Drawing Sheets

INTEGRATED STRUCTURE OF AIR HEATER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a household air heater, and more particularly to an integrated structure of a air heater which is easy for manufacture, assemble, and inspection.

2. Description of Related Arts

In our daily lives, air conditioning devices, such as air conditioners, electric fans, air heaters, cooling fans, and humidifiers, are widely used for controlling the temperature and moisture. In which, an air conditioner achieves the temperature adjusting effect by adsorbing heat of the air in a condensing process via media like coolant and refrigerant. An air heater heats the air inlet into the air heater by means of an electric heating unit, and then the heated air is exhaled to increase the room temperature. Currently, the air heater has been widely used for indoor warming due to its compact size, portable ability, good heating effect, and etc. A conventional air heater generally comprises a heating unit, a supporting frame, an air blowing unit, and a temperature control unit, and that the air heater further has an air passage, an air inlet, and an air outlet. When the power of the air heater is switched on to operate, the heating unit heats the inletting air from the air inlet, and then the heated air is guided to exit through the air outlet. The various components of the conventional air heater must be independently manufactured and assembled, and thus the overall structure is relatively complex, the assembling efficiency is low, inspection procedure is inconvenient, and the manufacturing cost is relatively high.

SUMMARY OF THE PRESENT INVENTION

The invention is advantageous in that it provides an integrated structure of an air heater which has a simple and compact structure, an easy and convenient assembling method, and a low manufacturing cost.

Additional advantages and features of the invention will become apparent from the description which follows, and may be realized by means of the instrumentalities and combinations particular point out in the appended claims.

According to the present invention, the foregoing and other objects and advantages are attained by an integrated structure of an air heater, comprising: at least an air blowing unit, at least an air passage housing provided corresponding to the air blowing unit, a heating arrangement, and an overheat protection unit for controlling the heating operation of the heating arrangement, which are integrally coupled with each other to provide an integrated structure, wherein air is drawn into the air passage by the air blowing unit, heated by the heating arrangement, and then is guided to get out of the air heater.

According to one embodiment, the air blowing unit, the air passage housing and the overheat protection unit are integrally to form an integral body, wherein the air blowing unit is connected with the air passage housing and the air passage housing is connected with the overheat protection unit and the heating arrangement.

According to one embodiment, the air blowing unit and the overheat protection unit are connected with the air passage housing while the air passage and the heating arrangement are integrally connected together by means a plurality of screwing members.

According to one embodiment, the air blowing unit comprises a body frame, which is a ring shaped frame, and a plurality of blades rotatably installed in the body frame, wherein the air blowing unit is an axial fan motor.

According to one embodiment, the air passage housing is a frame-type casing having an air inlet at a first side thereof, an air outlet at a second side thereof, and an air passage plate provided between the air inlet and the air outlet, wherein the air inlet has a shape corresponding to a shape of the body frame, wherein the air outlet has a shape corresponding to a shape of the heating arrangement, wherein the air passage plate has an arc shape, wherein the air blowing unit comprises a plurality of first coupling members provided on an circumference at a side portion of the body frame, wherein the air passage housing comprises a plurality of first retaining members on an outer circumference of the air inlet for fastening with the plurality of first coupling members respectively.

According to one embodiment, the first coupling member is a projecting member and the first retaining member is a coupling base for coupling with the projecting member in a tongue-groove manner, or the first coupling member is a coupling base and the first retaining member is a projecting member for coupling with the projecting member in a tongue-groove manner.

According to one embodiment, the first retaining member is a coupling base protruded from an inner surface along the air inlet of the air passage housing that defines a U-shape groove opened to an inner side, wherein the first coupling member is a projecting member which is firmly received in the U-shape groove.

According to one embodiment, the heating arrangement comprises a heating member and a supporting frame, wherein the supporting frame is a rectangular frame which comprises a receiving portion defining a receiving cavity for receiving the heating member, wherein the heating arrangement further comprises a plurality of second projecting members on inner surfaces of the receiving portion for coupling with the heating member.

Preferably, the air passage housing further comprise a plurality of second coupling bases provided on an outer circumference of the air outlet, wherein the heating arrangement comprises a plurality of third projecting members at an outer side of the receiving portion engaging with the plurality of second coupling bases respectively in such a manner that the air passage housing is firmly coupling with the heating arrangement.

According to one embodiment, the integrated structure of the air heater further comprises two connecting members spacedly provided on the outer side of the receiving portion of the supporting frame of the heating arrangement that defines two U-shape slots retaining the overheat protection unit in position.

According to one embodiment, the integrated structure of the air heater further comprises a plurality of lug bases protruded from an outer circumference along the air outlet, wherein each of the lug bases has a screw hole for coupling with the supporting frame, wherein heating arrangement further has a plurality of hollow pillars provided at the outer side of the receiving portion of the supporting frame, wherein the hollow pillars has positions corresponding to the positions of the lug bases respectively, wherein the screwing members are inserted into the hollow pillars and the lug bases so that the air passage housing is connected with the supporting frame.

According to one embodiment, the overheat protection unit is a temperature control device or a high-temperature cut-off device which is fastened with the two connecting members on the supporting frame.

According to one embodiment, the integrated structure comprises two air blowing units and two air passage housings in accordance with the two air blowing units.

In accordance with another aspect of the invention, the present invention provides a method of manufacturing an integrated structure of an air heater, wherein the method comprises the following steps.

(a) Dispose at least an air blowing unit at an air inlet of at least an air passage housing in such a manner that the air blowing unit is detachably coupled with the air passage housing.

(b) Install a heating member of a heating arrangement in a receiving portion of a supporting frame by pressing the heating member at a side portion thereof along a slanted surface of a plurality of second projecting members in such a manner that the heating member is retained in position in the receiving portion by the plurality of second projecting members which are protruded from inner surfaces of the receiving portion of the supporting frame.

(c) Fasten the air passage housing and the supporting frame with the heating arrangement respectively to provide the integrated structure of the air heater.

Preferably, the step (a) comprises a step of clockwise or counterclockwise rotating the air blowing unit in such a manner that a plurality of first projecting members on an outer circumference of the air blowing unit are coupled in a plurality of first coupling bases on the air passage housing respectively, so that the air blowing unit is coupled with the air passage housing.

Preferably, the step (c) comprises a step of integrating the air passage housing with the heating arrangement through a tongue-groove engagement between a plurality of second coupling bases on the passage housing and a plurality of third projecting members on the supporting frame of the heating arrangement Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferable embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
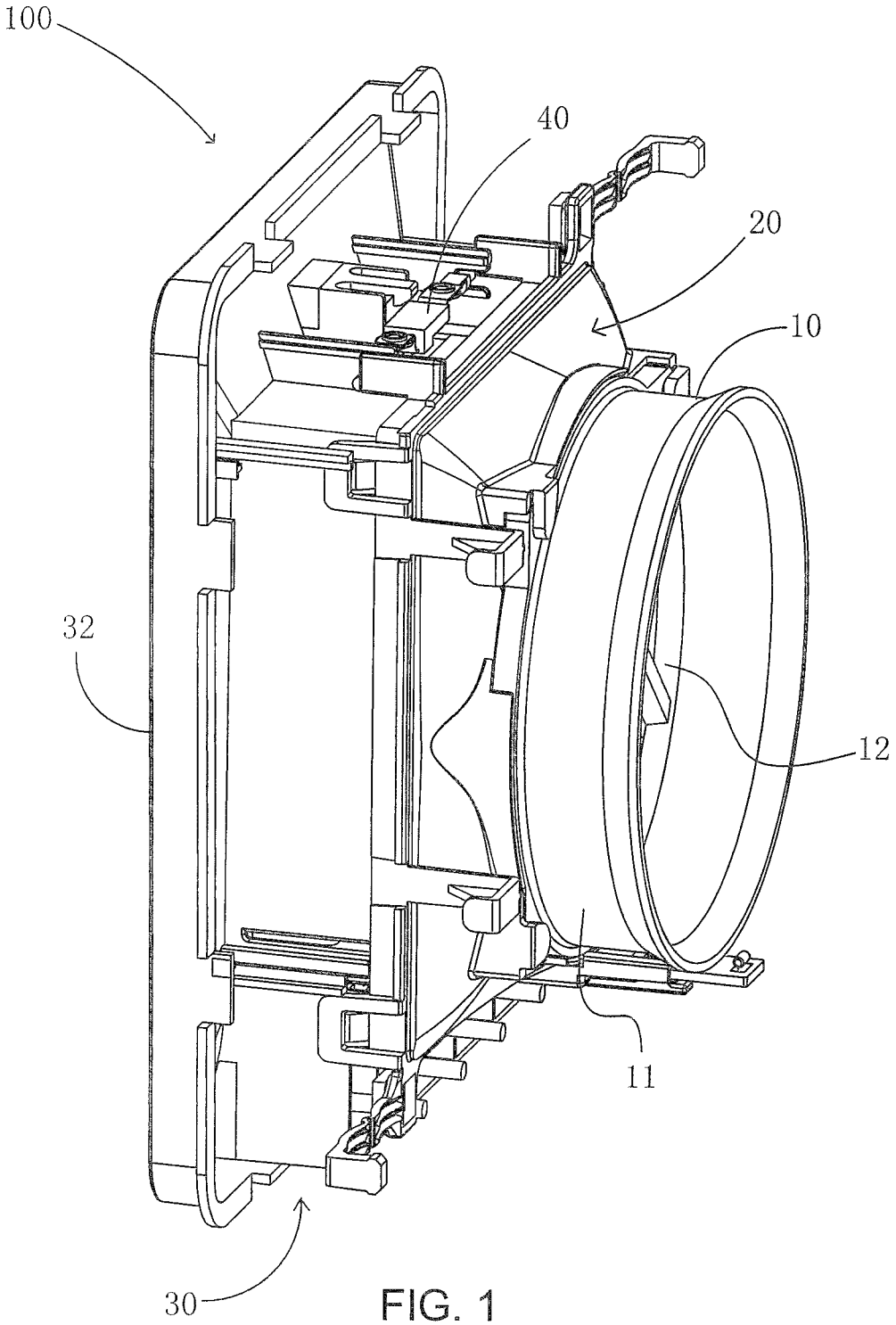
FIG. 1 is a perspective view of an air heater with a single air blowing unit according to a preferred embodiment of the present invention.
Figure 2:
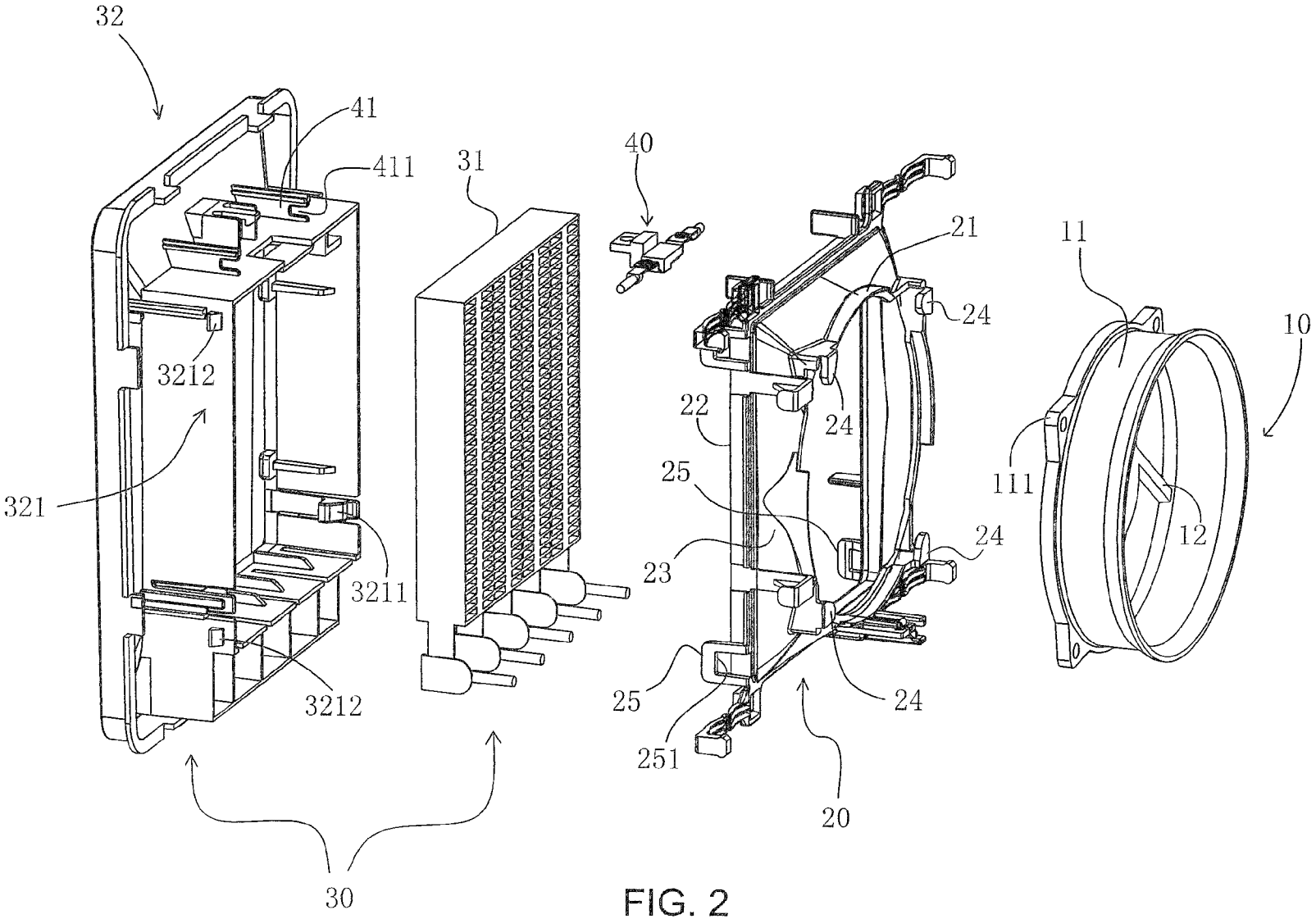
FIG. 2 is an exploded view of the air heater with the single air blowing unit according to the above preferred embodiment of the present invention.
Figure 4:
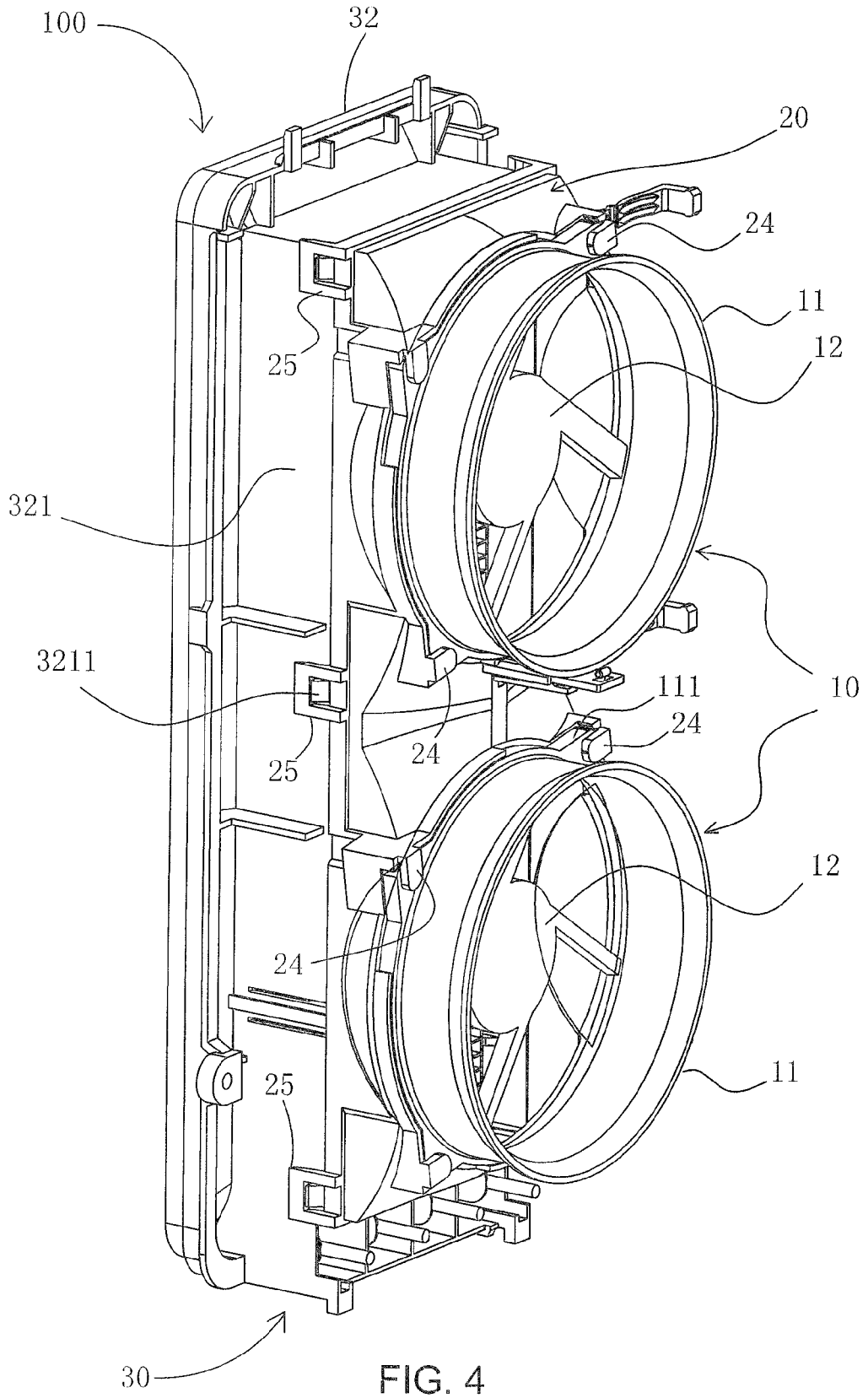
FIG. 4 is a perspective view of a air heater with two air blowing units according to an alternative mode of the above preferred embodiment of the present invention.
Figure 5:
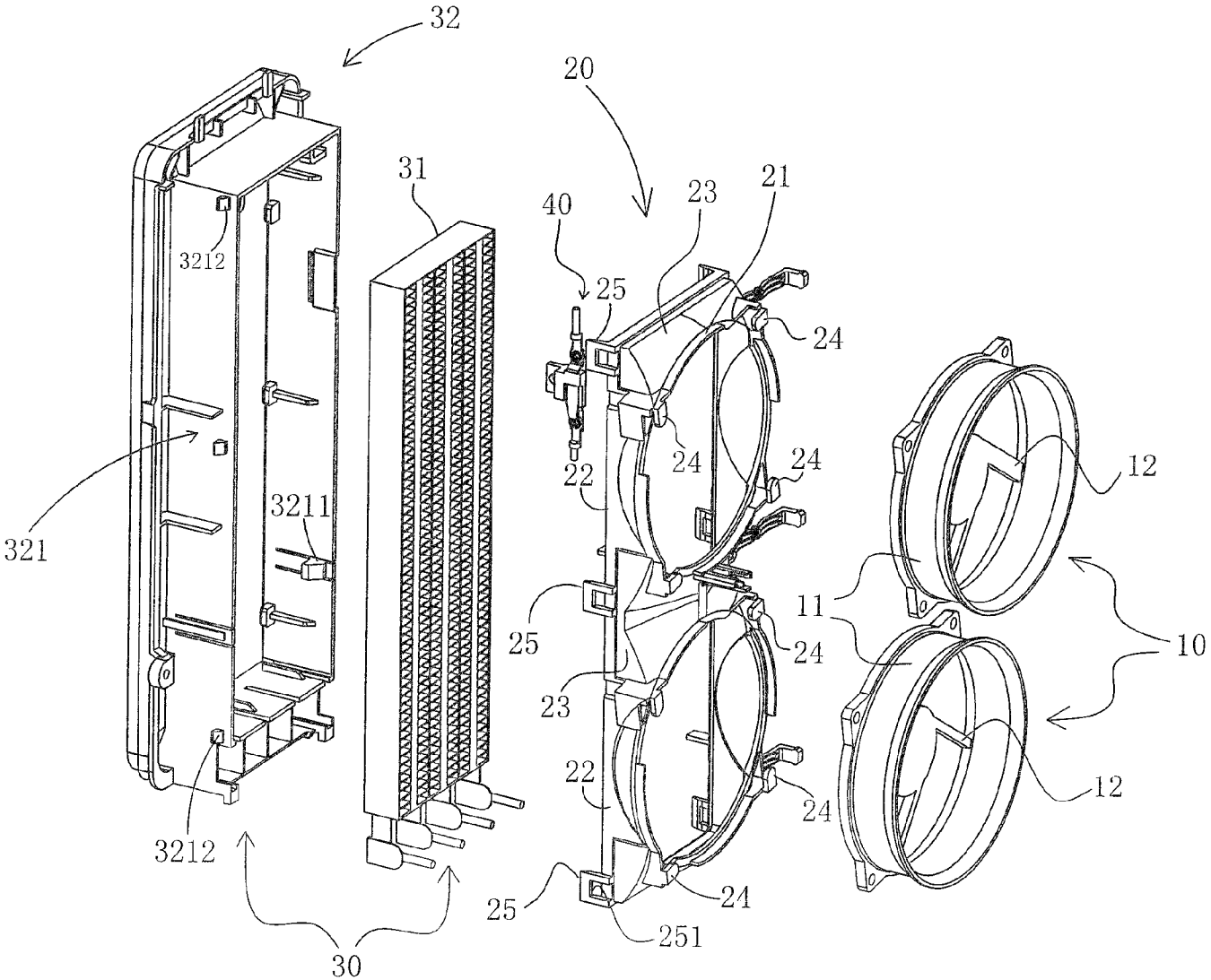
FIG. 5 an exploded view of the air heater with two air blowing units according to the alternative mode of the above preferred embodiment of the present invention.

Referring to FIGS. 1, 2, 4 and 5 of the drawings, an integrated structure 100 of a air heater according to a preferred embodiment of the present invention is illustrated. The integrated structure 100 of the air heater comprises an air blowing unit 10, an air passage housing 20, a heating arrangement 30, and an overheat protection unit 40. The air blowing unit 10 and the air passage housing 20 can be arranged to be a single air blowing unit, as shown in FIGS. 1 and 2 of the drawings, or alternatively, double air blowing units, as shown in FIGS. 4 and 5 of the drawings, wherein the two air blowing units 10 are arranged and aligned in an up-and-down manner vertically.

Referring to FIG. 1 to FIG. 2 of the drawings, the air heater with a single air blowing unit according to the above preferred embodiment of the present invention is illustrated. Accordingly, the integrated structure of the air heater comprises an air blowing unit 10, an air passage housing 20, a heating arrangement 30 and an overheat protection unit 40, which are integrated with each other to form an integral structure. More particularly, the air blowing unit 10, the air passage housing 20, the heating arrangement 30, and the overheat protection unit 40 are integrally connected together by means of buckling connection to form an integral structure, wherein the air blowing unit 10 is coupled with the air passage housing 20 and the air passage housing 20 and the overheat protection unit 40 are respectively coupled with the heating arrangement 30. For example, the air blowing unit 10 is detachably fastened with the air passage housing 20 and the air passage housing 20 and the overheat protection unit 40 are respectively and detachably fastened with the heating arrangement 30.

Referring to FIG. 4 to FIG. 5 of the drawings, the air heater with two air blowing units according to an alternative mode of the above preferred embodiment of the present invention is illustrated, wherein two air blowing units 10, two air passage housings 20 corresponding to the two air blowing units 10, a heating arrangement 30, and an overheat protection unit 40 are integrated with each other to form an integral structure by means of buckling connection, wherein the air blowing units 10 are coupled with the air passage housings 20, and the air passage housings 20 and the overheat protection unit 30 are respectively coupled with the heating arrangement 40. For example, the two air blowing units 10 are detachably fastened with the two air passage housings 20 respectively, and the two air passage housings 20 and the overheat protection unit 40 are respectively and detachably fastened with the heating arrangement 30.

Referring to FIG. 1 to FIG. 2 of the drawings, the air blowing unit 10 comprises a body frame 11 and a plurality of blades 12. Accordingly, the air blowing unit 10 is embodied as an external rotor axle air blower or other blowers. The plurality of blades 12 are rotatably installed in the body frame 11. The body frame 11, which is embodied as a ring-shaped frame, comprises a plurality of first coupling members 111 for coupling with the air passage housing 20. According to the present embodiment, the body frame comprises four first coupling members 111 which are embodied as block-shaped projecting members 111 spacedly protruded around an circumferential edge at an end of the body frame 11 for engaging with the air passage housing 20.

The sir passage housing 20 can be a frame-type casing. According to the preferred embodiment as shown in FIGS. 2, 4 and 5 of the drawings, the air passage housing 20 provides an upper installing position and a lower installing position for installing the two air blowing units 10 respectively. The air passage housing 20 has a ring shape air inlet 21 provided at a first side adjacent to the air blowing unit 10 and a circular shaped air outlet 22 provided at a second side adjacent to the supporting frame 32 of the heating arrangement 30, wherein the air inlet 21 has a respective shape corresponding to a shape of the body frame 11 of the air blowing unit 10, and that the air outlet 22 has a shape in correspondence with the shape of the heating arrangement 30. The air passage housing 20 further comprises an air passage member 23 provided between the air inlet 21 and the air outlet 22, wherein, preferably, the air passage member 23 is an arc shaped plate. The air passage housing 20 further comprises a plurality of first retaining members 24 for engaging with the plurality of first coupling members 111. More particularly, the air passage housing 20 comprises four first coupling bases 24 spacedly provided at an outer circumferential edge of the air inlet 21 to detachably engage with the four projecting members 111 respectively. Accordingly, each of the coupling bases 24 is and inwardly protruded from the outer circumferential edge of the air inlet 21 of the air passage housing to define a U-shape groove having an opening facing inwards, so that the projecting members 111 are able to be firmly received and engaged in the U-shape grooves of the coupling bases 24 respectively, so as to firmly engage the air passage housing 20 with the air blowing unit 10. The air passage housing 20 further comprise a plurality of, for example six, second retaining members 25 for engaging with the heating arrangement 30.

Each of the second retaining members 25 can be embodied as a plate-shape retaining base which is protruded from an outer circumferential edge of the air outlet 22 of the air passage housing 20. Each of the second retaining members 25 has a coupling hole 251, wherein the supporting frame 32 of the heating arrangement 30 comprises a plurality of block-shape second projecting members 3211 adapted for being received in the coupling holes 241 respectively.

Referring to FIGS. 2, 3, 5 and 6 of the drawings, the heating arrangement 30 comprises a heating member 31 and a supporting frame 32. The supporting frame 32 can be a rectangular frame which comprises a receiving portion 321 defining a receiving cavity for receiving the heating member 31. The heating arrangement 30 further comprises a plurality of second projecting members 3211 provided on inner surfaces of the receiving portion 321 for coupling with the heating member 31. Accordingly, two block-shape projecting members 3211 are protruded from two inner surfaces thereof respectively to retain the heating member 31 in position. It is worth mentioning that each of the second projecting members 3211 has a slanted surface at an inner side thereof so that the heating member 31 is easy to slide into the receiving cavity of the supporting frame 32. In addition, the heating arrangement 30 comprises a plurality of, for example six, block-shape third projecting members 3212 protruded at an outer side of the receiving portion 321, wherein the plurality of third projecting members 3212 is provided at positions corresponding to positions of the plurality of second retaining members 25 respectively. Referring to FIG. 2 to FIG. 7 of the drawings, a plurality of, for example two, connecting members 41 is spacedly provided at the outer side of the receiving portion 321, wherein each of the two connecting members 41 has a U-shape slot 411 for retaining the overheat protection unit 40. Accordingly, the overheat protection unit 40, which can be any suitable temperature control device or high temperature cut-off device, is fastened in the U-shape slot 411 of the connecting members 41.

Figure 3:
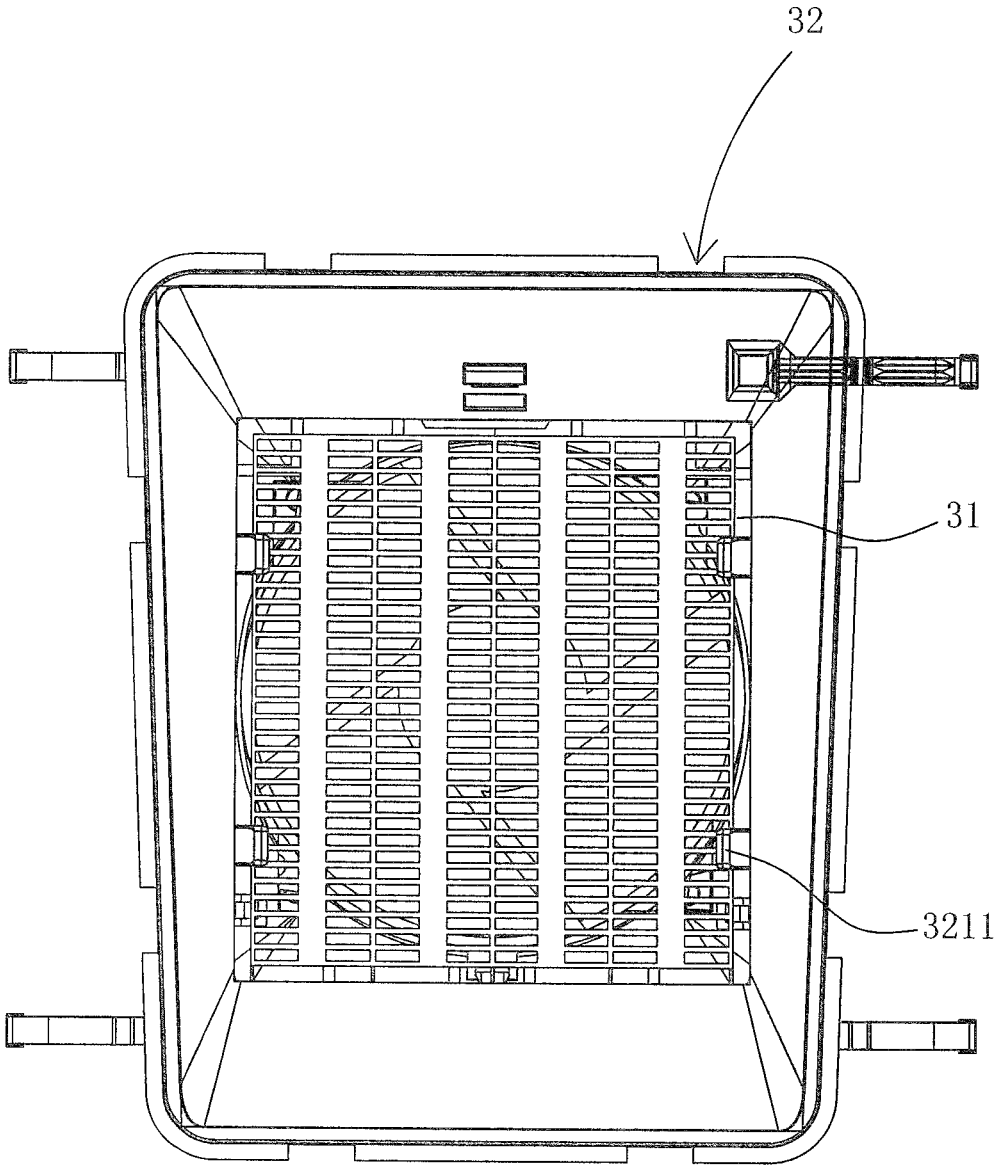
FIG. 3 is a schematic view illustrating the connection between the heating member and the supporting frame of the air heater with the single air blowing unit according to the above preferred embodiment of the present invention.
Figure 6:
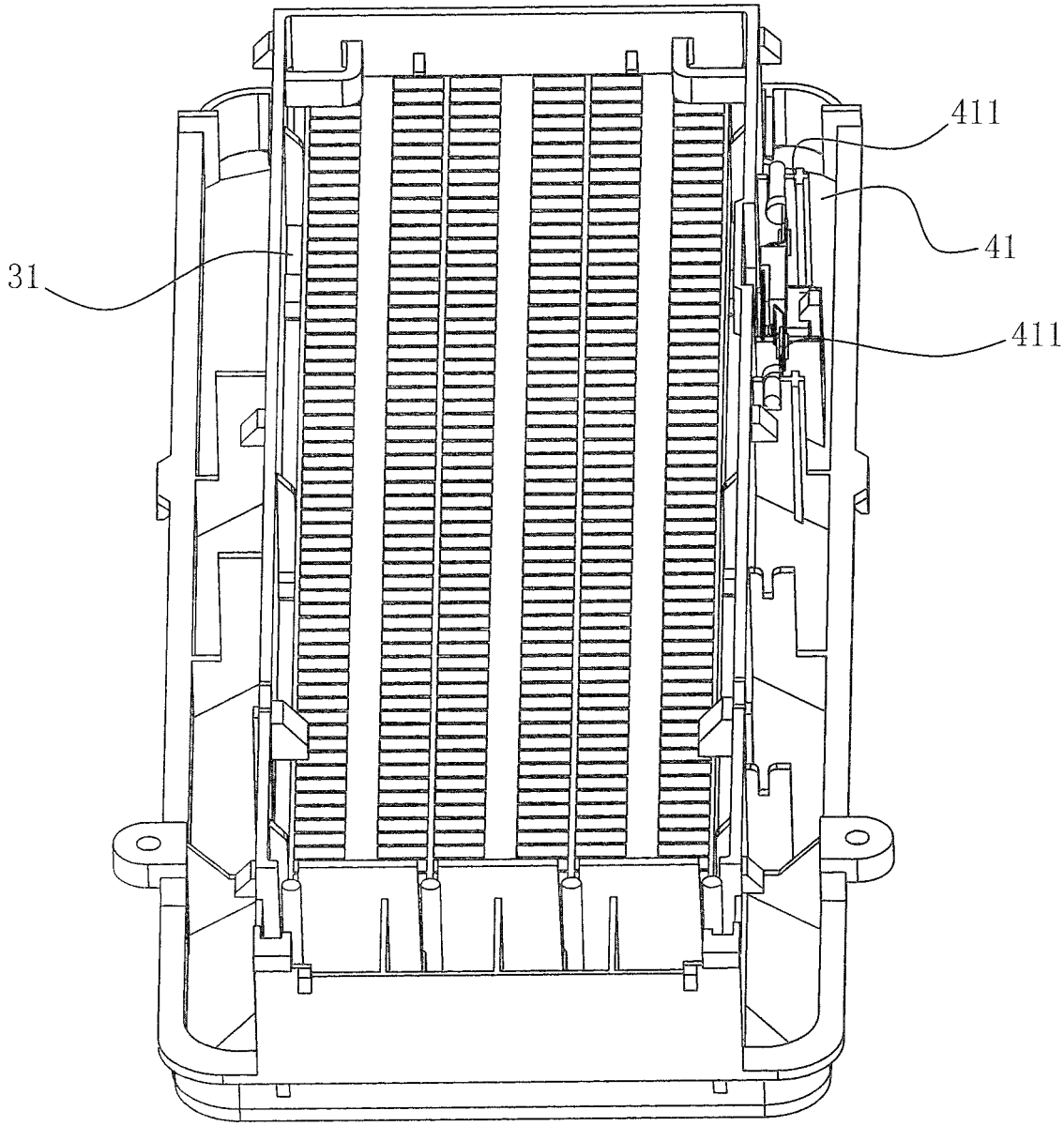
FIG. 6 is a schematic view illustrating the connection between the heating member and the supporting frame of the air heater with two air blowing units according to the alternative mode of the above preferred embodiment of the present invention.
Figure 7:
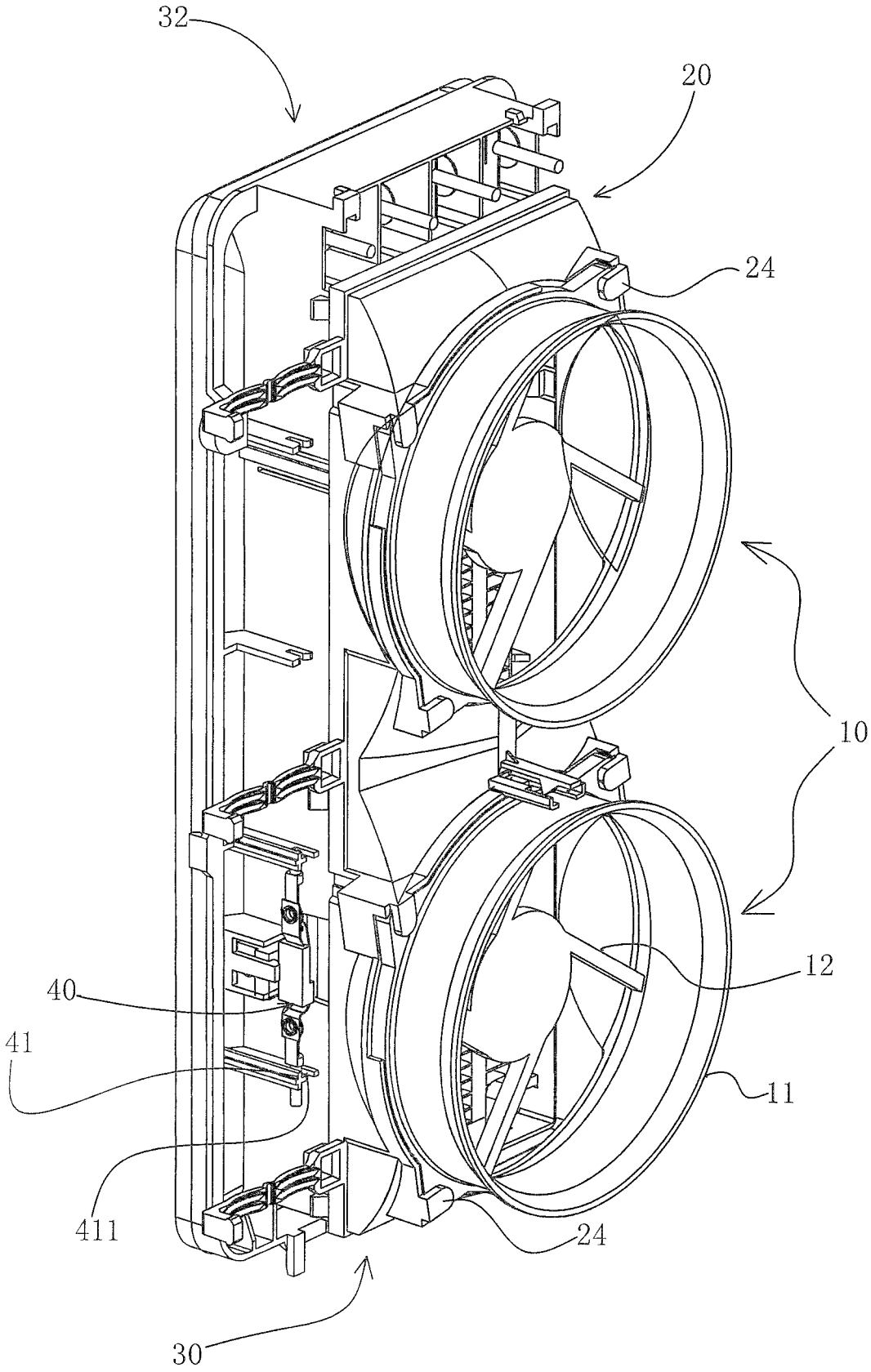
FIG. 7 is a schematic view illustrating the connection between the overheat protection unit and the supporting frame of the air heater with the two air blowing units according to the above alternative mode of the above preferred embodiment of the present invention.

The assembling method of the integrated structure of the air heater is shown in FIG. 1 to FIG. 6 of the drawings. Referring to FIGS. 1 and 4 of the drawings, the air blowing unit 10 is disposed at the air inlet 21 of the air passage housing 20 and is rotated clockwise or counterclockwise until the plurality of first projecting members 111 is fastened in the plurality of first retaining bases 24 of the air passage housing 20 respectively, so that the air blowing unit 10 is coupled with the air passage housing 20. Referring to FIGS. 3 and 6 of the drawings, the heating member 31 is installed into the receiving portion 321 of the supporting frame 32 in such a manner that an end portion of the heating member 31 is pressed along the slanted surfaces of the plurality of second projecting members 3211, so that the heating member 31 is received in the receiving portion because of the resilient deformation of the plurality of second projecting members 3211, and then the heating member 31 is retained in position by the plurality of second projecting members 3211. Referring to FIGS. 1 and 4 of the drawings, the air passage housing 20 and the supporting frame 32 are coupled with each other through the tongue-groove engagement between the plurality of second retaining bases 25 and the plurality of third projecting members 3212 of the supporting frame, so that the air passage housing 20 is integrated with the heating arrangement 30. Thus, the integrated structure 100 of the air heater which is shown in FIGS. 1 and 4 of the drawings is assembled. The integrated structure 100 is a pre-manufactured unit with all necessary components for manufacturing the air heater.

Figure 8:
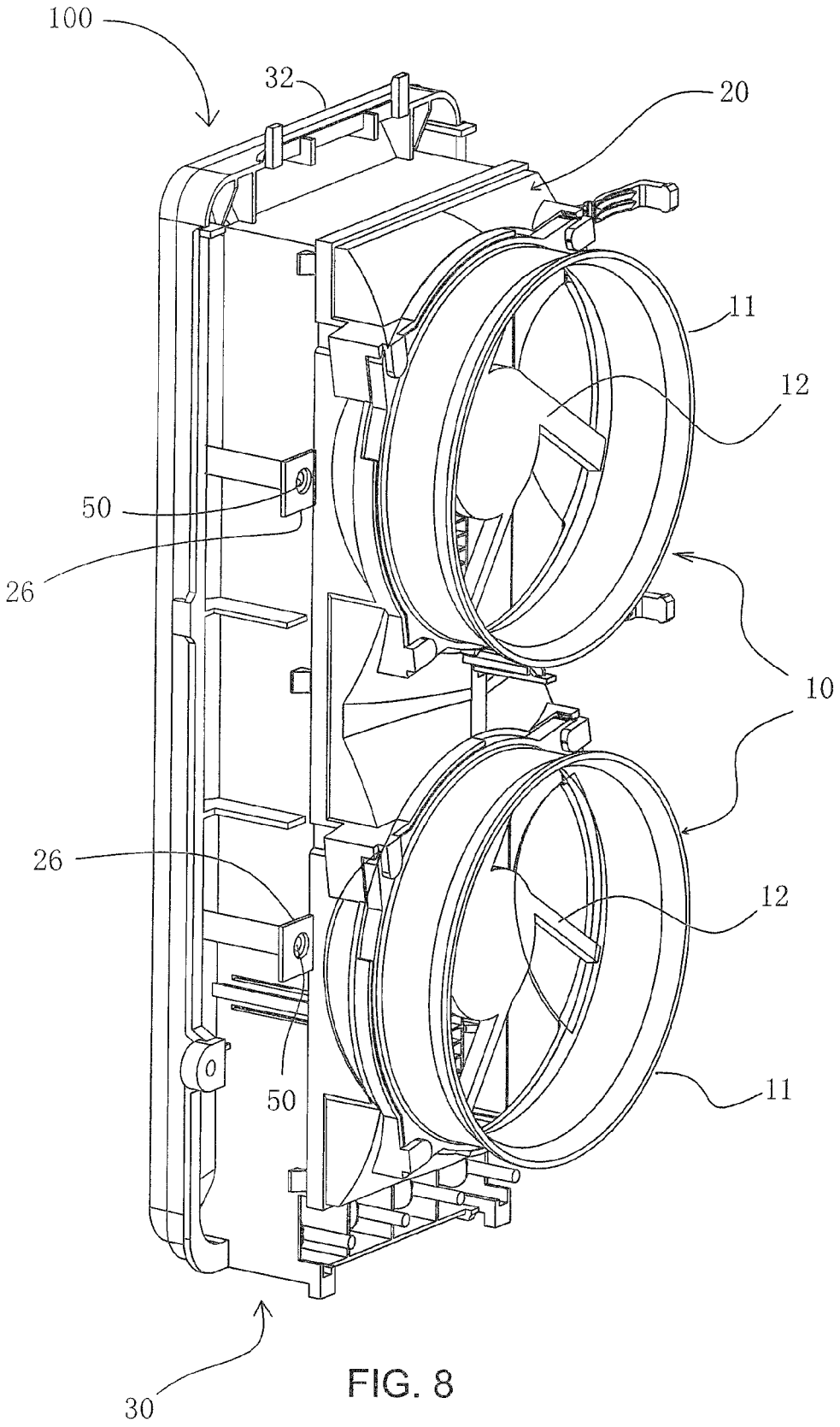
FIG. 8 is a perspective view of an air heater with two air blowing units according to a second preferred embodiment of the present invention.
Figure 9:
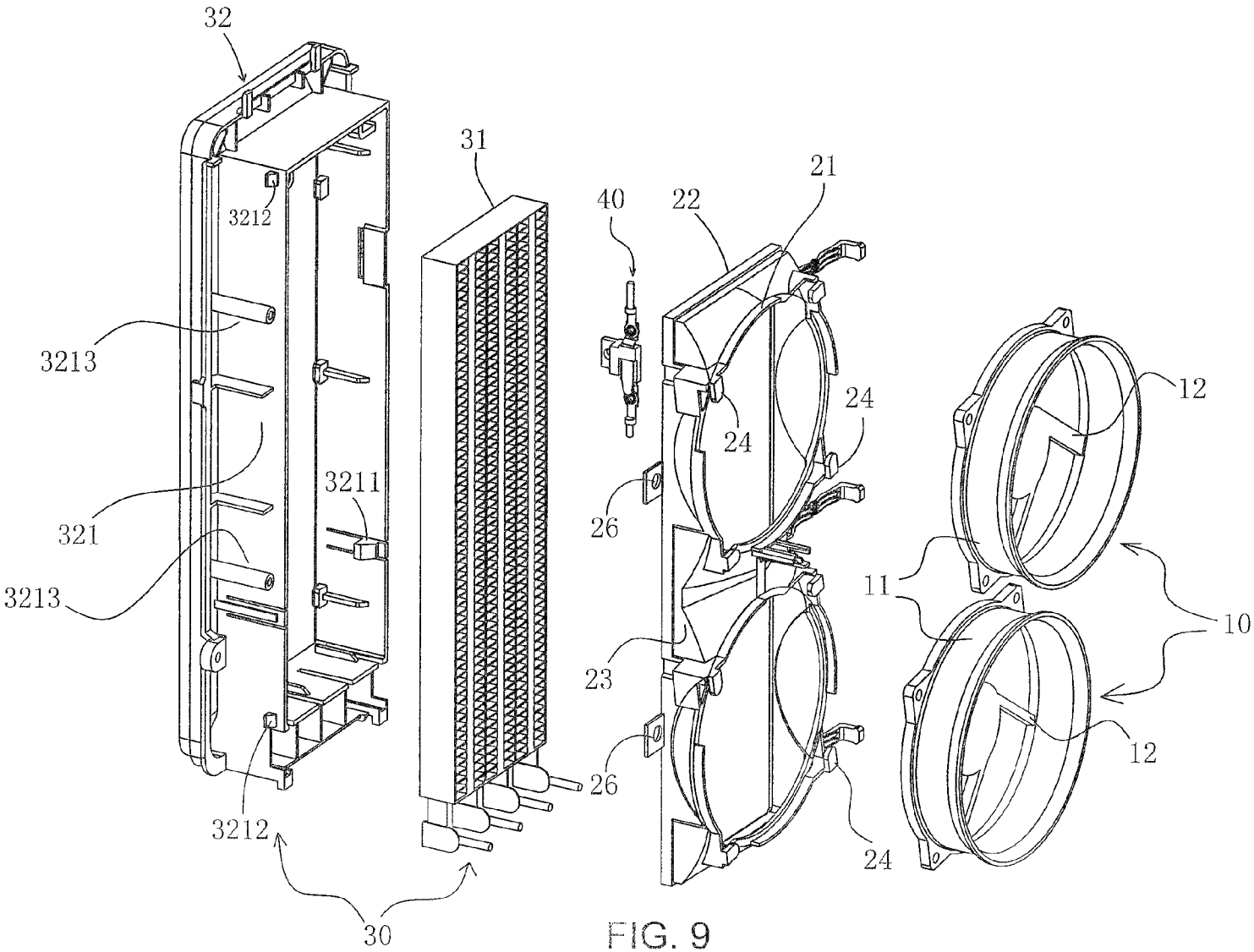
FIG. 9 is an exploded view of the air heater with the two air blowing units according to the above second preferred embodiment of the present invention.

Referring to FIG. 8 to FIG. 9 of the drawings, an integrated structure 100 of a air heater according to a second preferred embodiment of the present invention is illustrated, wherein the integrated structure 100 of the air heater has a similar structure with the integrated structure 100 of the air heater according to the above first preferred embodiment, wherein the difference is that the air blowing unit 10 and the overheat protection unit 40 are coupled with the air passage housing 20, and the air passage housing 20 is coupled with the heating arrangement 30 through a plurality of connection members such as screwing members 50.

More specifically, the air passage housing 20 comprises a plurality of lug bases 26 protruded from the outer circumferential edge around the air outlet 22, wherein each of the lug bases 25 has a receiving hole for coupling with the supporting frame 32. The receiving hole can be embodied into a screw hole. Correspondingly, a plurality of hollow pillars 3213 is provided at the outer side of the receiving portion 321 of the supporting frame 32, wherein the hollow pillars has positions corresponding to the positions of the lug bases respectively. The connection members which can be embodied as screwing members 50 are inserted into the hollow pillars 3213 and the lug bases 26 respectively, so that the air passage housing 20 is connected with the supporting frame 32 to form the integrated structure 100 of the air heater as shown in FIG. 8 of the drawings.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An integrated structure of an air heater, comprising:

at least an air passage housing, which is a frame-type casing having an air inlet at a first side thereof, an air outlet at a second side thereof, and an air passage member provided between said air inlet and said air outlet, wherein said air passage member is formed in arc shape, wherein said air passage housing comprises a plurality of first retaining members on an outer circumferential edge of said air inlet for coupling with a plurality of first coupling members respectively, wherein each of said first retaining members is a coupling base protruded from an inner surface of said air inlet of said air passage housing to define a U-shape groove having an opening facing inwards, wherein each of said first coupling members is a projecting member which is firmly received in said respectively U-shape groove, wherein said air passage housing further comprise a plurality of second coupling bases provided on an outer circumferential edge of said air outlet;

at least an air blowing unit detachably fastened with said corresponding air passage housing, wherein said air blowing unit, which is an external rotor axial air blower, comprises a body frame which is a ring shaped frame and a plurality of blades rotatably installed in said body frame, wherein said air blowing unit comprises a plurality of first coupling members provided on an circumferential edge at a side portion of said body frame;

a heating arrangement connected to said air passage housing to form the integrated structure, whereby air, which is drawn into said air passage housing by said air blowing unit, is heated by said heating arrangement and then guided to exit said air heater, wherein said heating arrangement comprises a heating member and a supporting frame, wherein said supporting frame is a rectangular frame which comprises a receiving portion defining a receiving cavity for receiving said heating member, wherein said heating arrangement further comprises a plurality of second projecting members on inner surfaces of said receiving portion for coupling with said heating member respectively, wherein said heating arrangement comprises a plurality of third projecting members at an outer side of said receiving portion for engaging with said plurality of second coupling bases respectively in such a manner that said air passage housing is firmly coupling with said heating arrangement; and an overheat protection unit connected with the heating arrangement to form the integrated structure for controlling heating operation of said heating arrangement, wherein said air passage housing and said overheat protection unit are respectively fastened with said heating arrangement, wherein said air inlet of said air passage housing has a shape corresponding to a shape of said body frame of said air blowing unit and said air outlet of said air passage housing has a shape corresponding to a shape of said heating arrangement.

2. The integrated structure of an air heater, as recited in claim 1, further comprising two connecting members spacedly provided on said outer side of said receiving portion of said supporting frame of said heating arrangement to define two U-shape slots retaining said overheat protection unit in position respectively.

3. The integrated structure of an air heater, as recited in claim 2, further comprising a plurality of lug bases protruded from an outer circumferential edge around said air outlet, wherein each of said lug bases has a screw hole for coupling with said supporting frame, wherein heating arrangement further has a plurality of hollow pillars provided at said outer side of said receiving portion of said supporting frame, wherein said hollow pillars have positions corresponding to said positions of said lug bases respectively, wherein said screwing members are inserted into said hollow pillars and said lug bases so that said air passage housing is connected with said supporting frame.

4. The integrated structure of an air heater, as recited in claim 3, wherein said overheat protection unit which is a temperature control device or a high-temperature cut-off device is coupled with said two connecting members on said supporting frame.

5. The integrated structure of an air heater, as recited in claim 4, wherein said integrated structure comprises two air blowing units and two air passage housings in accordance with said two air blowing units.

6. A method of manufacturing an integrated structure of an air heater, comprising the following steps:

(a) disposing at least an air blowing unit at an air inlet of at least an air passage housing in such a manner that said air blowing unit is detachably coupled with said air passage housing, and clockwise or counterclockwise rotating said air blowing unit until a plurality of first projecting members provided at an outer circumferential edge of said air blowing unit is fastened with a plurality of first coupling bases provided on said air passage housing respectively, so that said air blowing unit is fastened with said air passage housing;

(b) installing a heating member of a heating arrangement in a receiving portion of a supporting frame by pressing said heating member at a side portion thereof along a slanted surface of a plurality of second projecting members in such a manner that said heating member is retained in position in said receiving portion by said plurality of second projecting members which are protruded from inner surfaces of said receiving portion of said supporting frame; and (c) fastening said air passage housing and said supporting frame with said heating arrangement respectively to form the integrated structure, and integrating said air passage housing with said heating arrangement through a tongue-groove engagement between a plurality of second coupling bases provided on said air passage housing and a plurality of third projecting members provided on said supporting frame of said heating arrangement.

* * * * *